US005144785A

United States Patent [19]

Berglund

[11] Patent Number: 5,144,785

[45] Date of Patent: Sep. 8, 1992

[54] GIRDER

[76] Inventor: Reidar Berglund, Pl 2678, S-810 28, Järbo, Sweden

[21] Appl. No.: 646,712

[22] PCT Filed: Jul. 31, 1989

[86] PCT No.: PCT/SE89/00423

§ 371 Date: Feb. 1, 1991

§ 102(e) Date: Feb. 1, 1991

[87] PCT Pub. No.: WO90/01599

PCT Pub. Date: Feb. 22, 1990

[30] Foreign Application Priority Data

Aug. 2, 1988 [SE] Sweden ..... 8802788

[51] Int. Cl.[5] ..... E04C 3/29; E04C 3/14; E04B 1/76

[52] U.S. Cl. ..... 52/730; 52/737; 52/743; 52/404; 52/690; 52/745; 52/732

[58] Field of Search ..... 52/729, 730, 733, 734, 52/737, 738, 732, 740, 743, 407, 406, 404, 690, 692, DIG. 8, 739, 745, 746

[56] References Cited

U.S. PATENT DOCUMENTS

| | | | |
|---|---|---|---|
| 1,888,841 | 11/1932 | Wenzel et al. | 52/743 |
| 2,172,048 | 9/1939 | Johnson | 52/407 |
| 2,886,857 | 5/1959 | Brosenius | 52/729 |
| 2,896,278 | 7/1959 | Wasserback | 52/404 |
| 4,724,651 | 2/1988 | Fligg | 52/407 X |
| 5,079,894 | 1/1992 | Lau | 52/732 |

*Primary Examiner*—Richard E. Chilcot, Jr.
*Assistant Examiner*—Robert Canfield
*Attorney, Agent, or Firm*—Diller, Ramik & Wight

[57] ABSTRACT

A girder as defined by a separate sheet-like web (3) having opposite first and second edges and opposite first and second flat sides. First and second mutually spaced elongated members (2', 2") extending substantially parallel to each other are secured to respective opposite edges and opposite sides of the sheet-web. A plurality of separate transverse members (5) spaced from each other are disposed normal to the elongated first and separate members and are secured thereto and to the web (3). A girder so constructed can be positioned against an existing building exterior wall and nailed through either of the elongated members with these and in the absence of interference from the other of the elongated members.

30 Claims, 2 Drawing Sheets

GIRDER

TECHNICAL FIELD OF THE INVENTION AND PRIOR ART

The present invention relates to a girder for building purposes, comprising two mutually spaced elongated wood bands or members extending substantially parallel to each other and a sheet-like web rigidly interconnecting the bands.

Such girders are already known through for, example, U.S. Pat. No. 4,336,678, FR patent 1 230 119, and SE published patent application 389 883, and they are generally called "light girders". Girders of this type are used, instead of girders of solid wood, to achieve two main advantages which light girders have over solid girders. First, a "light girder" requires considerably less material and is therefore cheaper than a solid girder. As a consequence of this, it will of course be easier to handle because of its low weight. Secondly, because of the thin web a considerable reduction of thermal conductivity is obtained, i.e. conduction of heat (or cold) through the girder is made more difficult, as compared to the solid girders.

The girders hitherto known of the type mentioned in the introduction could only be used as walls, floors and the like when buildings were originally erected, but they could not be used for application on existing building surfaces, such as external walls or garret floors to effect additional insulation. The reason for not using the so called "light girders" for these purposes is that they could not be applied in a rational way by nailing, screwing or the like on a large existing surface. Solid girders have therefore been used in this type of additional works on existing buildings, and by that material as well as insulating capacity, are lost as compared to light girders.

BRIEF DESCRIPTION OF THE INVENTION

The object of the present invention is to inconveniences mentioned above of the girders already known of provide a "light girder" which solves the problems of conventional girders and can be used on existing large building surfaces with the advantages discussed above. The light girder according to the invention is also well suited for use in, for example, roofs, walls and floors in the original erection of buildings.

Through the fact that the two elongated wood bands are arranged on opposite flat sides of the sheet-like web, it is easy to apply the girder according to the invention on a building surface through one of the two elongated wood bands, since the other band is not in the way when nailing, screwing or the like through the band in question, and at the same time the stability and rigidity of a plurality of spaced girder is assured by the transversal wood bands or member.

Preferably, but not necessary, the girder is applied on the building surface in question through the elongated wood band arranged on the opposite flat side of the web with respect to the transversal wood bands, since in such a case on one hand the transversal bands may not be in the way when applying the girder, irrespective of where this is accomplished along the elongated wood band, and on the other the elongated wood band located on the same side as the transversal bands may become the support from the transversal bands when applying an outer covering, such as a wall covering, on the outside of the frame work formed by several girders arranged on a building surface.

The girder according to the invention is naturally also adapted for new constructions, but it has the greatest advantages as compared to the girders of the prior art in the application on existing buildings, for instance in order to provide additional insulation.

Further advantages and advantageous characteristics of the invention will appear from the following description of a preferred embodiment of the invention.

With reference to the appended drawings, below follows a specific description of an embodiment according to the invention cited as an example.

DETAILED DESCRIPTION OF A PREFERRED EMBODIMENT OF THE INVENTION

Figure 1:
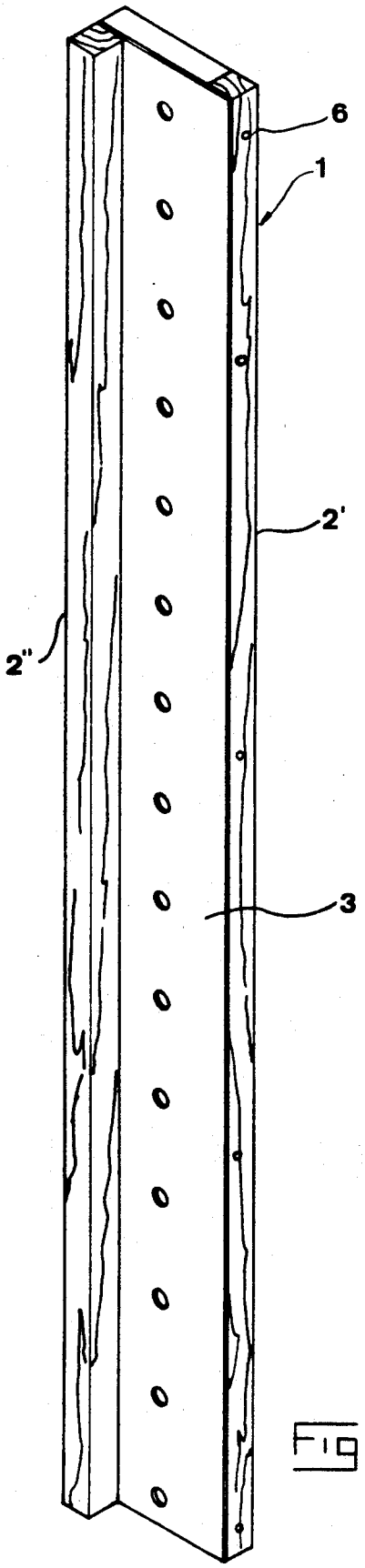
FIG. 1 is a perspective view of a preferred embodiment of the girder according to the invention.
Figure 2:
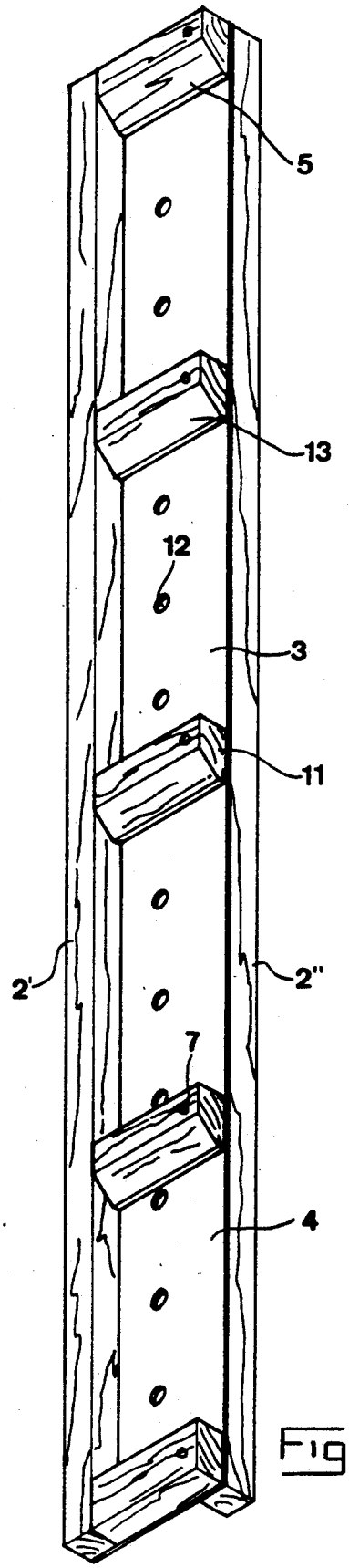
FIG. 2 is a perspective view of the girder according to FIG. 1, but from the opposite direction.

A girder 1 according to a preferred embodiment of the invention is shown in perspective from opposite directions in FIG. 1 and 2. The girder 1 has two mutually spaced elongated wood bands or members 2', 2" extending substantially parallel to each other and a sheet-like web 3, which preferably consists of a wood fiber board, for example of the type sold under the trade mark MASONITE, of a thickness of, for example 5 mm, interconnecting the bands 2', 2". The elongated wood bands 2', 2" are secured on opposite flat sides of the web 3, for instance by securing cramps, or staples which have been shot thereon by conventional cramp or staple guns, but gluing or the like is also possible. On the first flat side 4 of the web 3 a plurality of transversal or transverse wood bands or members 5 bearing upon the web 3 and extending substantially perpendicularly to the longitudinal direction of the bands 2', 2", from the first band 2' secured to the same flat side and to the opposite end of the web 3, are fixed at intervals. The transversal wood bands 5 are fixed on one hand to the first elongated band 2' by nails 6 (See FIG. 1), which have been driven through the elongated band 2' and into the transversal band 5 in question, and on the other to the web 3 and the second elongated band 2" by nails 7 (See FIG. 2), which have been driven into the transversal band 5 in question and through the web 3 and into the second elongated band 2". In this way a strong girder is obtained, and this strength may be adapted to the demands made by different conditions by varying the distance between the transversal wood bands 5 or the dimensions of the different parts of the girder.

It shall here be brought out clearly that the definition wood band also comprises bands composed by wood laminae, bands consisting of wood that have been broken up and then pressed together (of the particle board type) and bands of wood containing other materials, such as plastic or metals.

Figure 3:
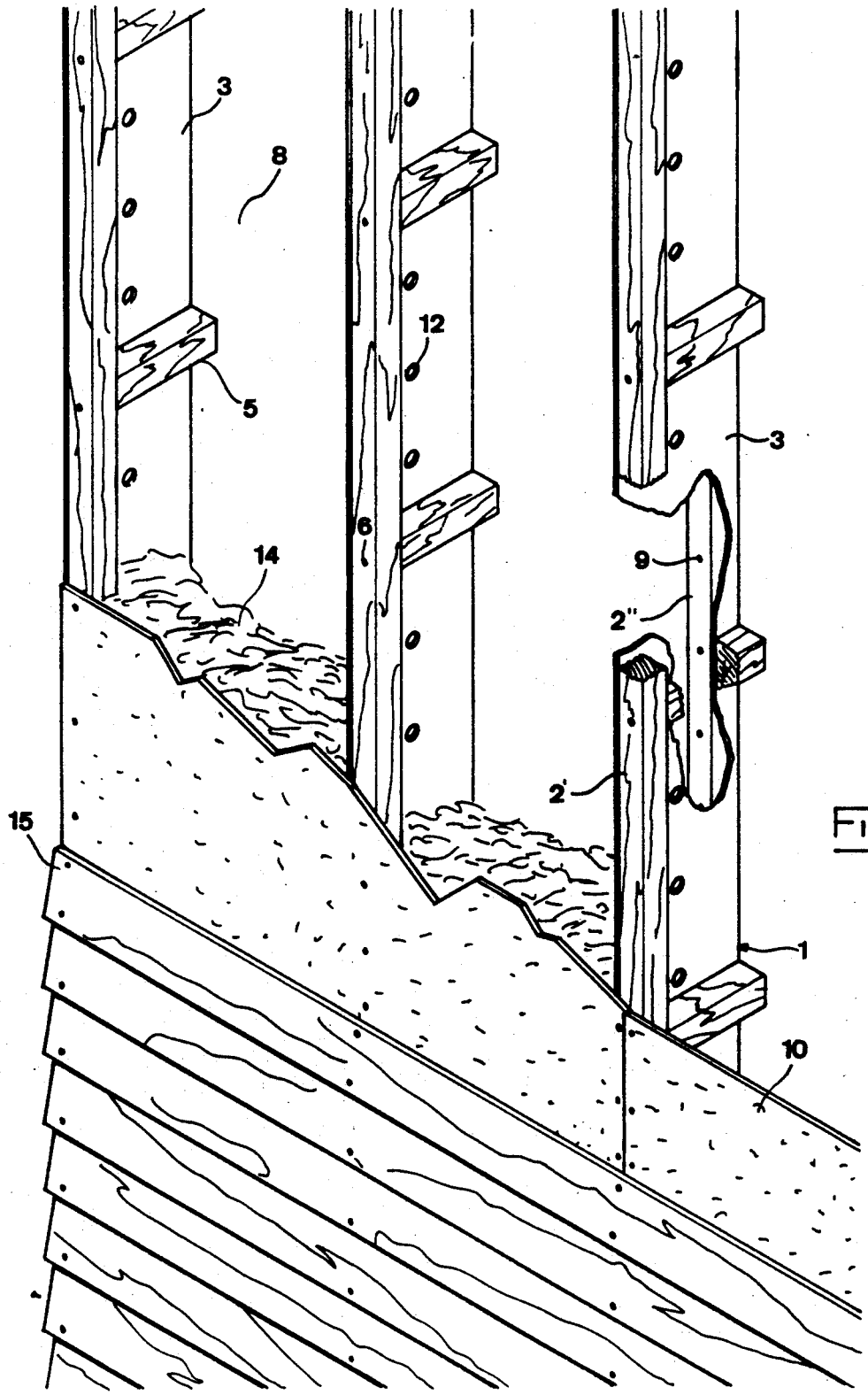
FIG. 3 is a partially sectioned perspective view of the portion of an external wall of a building additionally insulated by means of girders according to the invention.

The further structure of the girder 1 shall now be explained with reference also to FIG. 3, which shows a number of girders 1 applied on an external wall 8 of a building for insulating purpose. Owing to the fact that the two elongated wood bands 2', 2" of the girder according to the invention are arranged on opposite flat sides of the web 3, it is possible to secure the girder on an existing surface in a very rational way, since good accessibility for example nailing is obtained in the region of the two elongated bands 2', 2''. The girder is preferably nailed on an external wall 8 by applying the second elongated band 2'' against the surface of the wall 8 and driving nails 9 through the band and 2'' into the wall 8. A piece of the web 3 of the right girder shown in FIG. 3 has been broken away in order to illustrate this. Thereafter a covering 10 allowing humidity diffusion, such as any type of plates or cardboard, may be secured on the outside of the girders by nailing or the like into the first elongated band 2'. Subsequently, an external covering 15, e.g. wood panelling or siding is applied by nailing, screwing or the like in the bands 2' on the outside of the bands 2'. The transversal bands 5 will bear upon the external wall 8 through their surfaces 11 directed away from the band 2' and support the first elongated bands 2' in their supporting of the new external wall of the building. They do also prevent the first elongated band 2' from loosening from the web 3 upon the nailing of the wall coverings 10, 15.

The web of the girder according to the invention is provided with a number of through bores 12. Furthermore, the lower surface 13 of the transversal bands is obliquely directed with respect to the vertical line, preferably at about 45° (See FIG. 2). The object of these two characteristics is to prevent air spaces from being formed during a method of providing additional insulation of external building walls according to the invention. In this method, after attaching the wall coverings 10, 15 outside the girders, an insulating composition or mass 14 is injected in the rooms formed between the girders 1, the previous external wall 8 and the wall coverings 10, 15. The bores 12 act as escape ways for the air present in these rooms or spaces, while the inclined lower surfaces 13 of the transversal bands 5 assure that no air spaces are formed under any transversal band on injection of the insulating material.

Thus, thanks to the provision of the girders 1 according to the invention it has become possible to utilize a totally new method of providing additional insulation to external walls of buildings. Previously, additional insulation boards were secured directly onto the house wall and after this a wall covering was secured to these, but since a house wall nearly always is uneven so called levelling has to be done, i.e. pieces of, for example, wood are placed behind certain girders in order to bring their external surface in the same plane as the other girders, which results in cavities between at least some of the insulating boards and the original wall surface behind them and through this results inferior insulation. The present invention avoids such inconveniences by means of the injection of the insulating material described above, which totally fills all the spaces between the previous and the new external wall.

The invention is of course not in any way restricted to the preferred embodiment described above, but a plurality of modification possibilities should be apparent to a person having ordinary skill in the art, without departing from the basic idea of the invention.

It would also be possible to apply the girder 1 according to the invention with the elongated wood bands arranged on the same flat side of the web as the transversal bands against existing building surface, if this would be desired.

By definition, "a web" also includes several sheet-like elements which may be arranged with a certain interruption between each other.

The shape of the transversal bands may, of course, be varied, and it is not necessary in every application that the web has through bores.

The girder 1 according to the invention may, of course, be used as an ordinary girder in erecting buildings or also for additional insulation of all kinds of surfaces, also including floors, roof frames and the like.

It would also be conceivable to arrange transversal bands 5 on both flat sides of the web 3. The insulating method according to the invention means that no exact girder distance is necessary, but this distance may be varied beyond the standard measures being imposed in conventional insulation as a result of certain dimensions of the insulating sheets or the like.

I claim:

1. A girder comprising separate first and second mutually spaced elongated members (2', 2'') extending substantially parallel to each other, a separate sheet-like web (3) having opposite first and second edges and opposite first and second flat sides, first means for securing said first elongated member (2') to said first flat side along said first edge, second means for securing said second elongated member (2'') to said second flat side along said second edge, said sheet-like web (3) being devoid of elongated members along said first edge second flat side and said second edge first flat side, a plurality of separate transverse members (5) spaced from each other and disposed generally normal to said elongated first and second members, and third means for securing each of said transverse members to at least one of said first and second elongated members and said sheet-like web.

2. The girder as defined in claim 1 wherein said second and third securing means are one and the same.

3. The girder as defined in claim 1 wherein at least a pair of said first, second and third securing means are disposed generally normal to each other.

4. The girder as defined in claim 1 wherein said first and second elongated members each include inner and outer surfaces and abutment surfaces therebetween, said elongated members being positioned with said abutment surfaces abutting said sheet-like web and with said inner surfaces facing relative to each other; and said third securing means penetrate said first elongated member from said outer surface thereof, exit said inner surface thereof and penetrate said transverse members.

5. The girder as defined in claim 1 wherein said first and second elongated members each include inner and outer surfaces and abutment surfaces therebetween, said elongated members being positioned with said abutment surfaces abutting said sheet-like web and with said inner surfaces facing relative to each other; and said third securing means penetrate said second elongated member, said transverse member and said sheet-like web along said second edge.

6. The girder as defined in claim 1 wherein said first and second elongated members each include inner and outer surfaces and abutment surface therebetween, said elongated members being positioned with said abutment surfaces abutting said sheet-like web and with said inner and outer surfaces being respectively adjacent and remote relative to each other; said third securing means include first fasteners which penetrate said first elongated member from said outer surface thereof exiting said inner surface thereof and penetrating said transverse members; and said third securing means further include second fasteners which penetrate said second elongated member, said transverse member and said sheet-like web along said second edge.

7. The girder as defined in claim 1 wherein said first and second securing means are fasteners disposed substantially parallel to each other, and said third securing means are fasteners disposed substantially normal to said first-mentioned fasteners.

8. The girder as defined in claim 1 wherein said web consists of bound together wood particles.

9. The girder as defined in claim 1 wherein said first, second and third securing means are securing cramps.

10. The girder as defined in claim 1 wherein each transverse member has longitudinally opposite first and second end surfaces, said first end surface of each transverse member being adjacent the inner surface of said first elongated member, and said second end surface of each transverse member being adjacent the outer surface of said second elongated member.

11. The girder as defined in claim 1 wherein each transverse member has longitudinally opposite first and second end surfaces, said first end surface of each transverse member being adjacent the inner surface of said first elongated member, and said second end surface of each transverse member being adjacent and generally parallel to the outer surface of said second elongated member.

12. The girder as defined in claim 1 wherein each transverse member has longitudinally opposite first and second end surfaces, said first end surface of each transverse member being adjacent the inner surface of said first elongated member, and said second end surface of each transverse member being adjacent and generally coincident to the outer surface of said second elongated member.

13. The girder as defined in claim 1 wherein said elongated members are generally of a polygonal cross-sectional configuration.

14. The girder as defined in claim 1 including bores passing through said sheet-like member on opposite sides of at least one of said transverse members.

15. The girder as defined in claim 1 wherein each transverse member includes upper and lower surfaces, said upper surfaces are generally horizontal, and said lower surfaces are inclined to the vertical.

16. The girder as defined in claim 1 wherein each transverse member includes upper and lower surfaces, said upper surfaces are generally horizontal, and said lower surfaces are inclined to the vertical at an angle of substantially 45 degrees.

17. A method of insulating a building having an exterior wall comprising the steps of providing a plurality of girders each defined by a separate elongated sheet-like web having opposite first and second flat sides and first and second edges with separate first and second elongated members being secured generally parallel to each other along the respective first and second edges and against the respective first and second flat sides and with a plurality of spaced transverse members secured to the first flat side generally normal to the elongated members, placing a plurality of the girders against an exterior wall of an existing building, securing one of the elongated members of at least one of the girders to the existing building exterior wall, securing a covering to another of the elongated members of at least one of the girders and thereby define a plurality of spaces between the girders, the covering and existing building exterior wall, and filling the spaces with insulating material.

18. The building insulating method as defined in claim 17 wherein each transverse member has opposite end faces, further comprising the step of positioning at least one of the girders with one of the transverse member end faces in opposition to the existing building exterior wall.

19. The building insulating method as defined in claim 17 wherein each transverse member has opposite end faces with a first end face opposing an associated first elongate member and a second end face remote from the associated first elongated member further comprising the step of positioning at least one of the girders with the remote second end faces thereof in opposition to the existing building exterior wall.

20. The building insulating method as defined in claim 17 wherein each transverse member has opposite end faces with a first end face opposing an associated first elongated member and a second end face remote from the associated first elongated member, further comprising the step of positioning at least one of the girders with the remote second end faces thereof in opposition to the existing building exterior wall, and positioning at least one of the girders with the first elongated member thereof in opposition to the existing building exterior wall.

21. The building insulating method as defined in claim 18 wherein the first and one elongated members are one and the same.

22. The building insulating method as defined in claim 19 wherein the first and one elongated members are one and the same.

23. The building insulating method as defined in claim 20 wherein the first and one elongated members are one and the same.

24. The building insulating method as defined in claim 17 wherein the sheet-like web is devoid of elongated members along the first edge second flat side and the second edge first flat side.

25. The building insulating method as defined in claim 18 wherein the sheet-like web is devoid of elongated members along the first edge second flat side and the second edge first flat side.

26. The building insulating method as defined in claim 19 wherein the sheet-like web is devoid of elongated members along the first edge second flat side and the second edge first flat side.

27. The building insulating method as defined in claim 20 wherein the sheet-like web is devoid of elongated members along the first edge second flat side and the second edge first flat side.

28. The building insulating method as defined in claim 21 wherein the sheet-like web is devoid of elongated members along the first edge second flat side and the second edge first flat side.

29. The building insulating method as defined in claim 22 wherein the sheet-like web is devoid of elongated members along the first edge second flat side and the second edge first flat side.

30. The building insulating method as defined in claim 23 wherein the sheet-like web is devoid of elongated members along the first edge second flat side and the second edge first flat side.

* * * * *